US006883179B1

(12) United States Patent
Crum

(10) Patent No.: US 6,883,179 B1
(45) Date of Patent: Apr. 26, 2005

(54) COMPOSITE GARMENT AND METHOD TO MANUFACTURE SAME

(75) Inventor: Joan Crum, Memphis, TN (US)

(73) Assignee: American Clothing Express, Inc., Memphis, TN (US)

( * ) Notice: Subject to any disclaimer, the term of this patent is extended or adjusted under 35 U.S.C. 154(b) by 0 days.

(21) Appl. No.: 10/897,962

(22) Filed: Jul. 23, 2004

(51) Int. Cl.[7] ..... A41D 1/22; A41C 1/14; A41C 27/02

(52) U.S. Cl. ..... 2/105; 2/272; 2/255

(58) Field of Search ..... 2/105, 106, 73, 2/78.1–78.4, 272, 255–264, 211, 275; 450/30–32

(56) References Cited

U.S. PATENT DOCUMENTS

| | | | | |
|---|---|---|---|---|
| 742,904 A | | 11/1903 | Reznick | |
| 1,447,537 A | * | 3/1923 | Ells | 450/136 |
| 2,341,032 A | | 2/1944 | Freed et al. | |
| 2,531,994 A | | 11/1950 | Stain | |
| 2,605,469 A | | 8/1952 | Licht | |
| 2,632,244 A | | 4/1953 | Lewis | |
| 3,098,485 A | | 7/1963 | Howell | |
| 3,314,432 A | * | 4/1967 | Erteszek | 450/31 |
| 4,571,742 A | | 2/1986 | Wior | |
| 6,540,560 B1 | | 4/2003 | Ito et al. | 439/633 |

* cited by examiner

*Primary Examiner*—Gloria M. Hale
(74) *Attorney, Agent, or Firm*—Butler, Snow, O'Mara, Stevens & Cannada PLLC

(57) ABSTRACT

This patent describes a composite garment made of (1) a dress having a top edge and a fastenable opening; and (2) a liner comprising a bodice support and a slip, the bodice support having a top edge and bottom edge, the bodice support having a fastenable opening coexistent with the fastenable opening of the dress, the bodice support having a plurality of stays extending from substantially the top edge of the bodice support to the bottom edge of the bodice support, wherein the plurality of stays are placed in close proximity to each other, the slip attached to the bottom edge of the bodice support, wherein the top edge of the dress is attached to the top edge of the bodice support. A bodice support of a composite garment is also described in this patent. A method to manufacture the composite garment is also described in this patent.

21 Claims, 6 Drawing Sheets

COMPOSITE GARMENT AND METHOD TO MANUFACTURE SAME

RELATED APPLICATIONS

NOT APPLICABLE

STATEMENT REGARDING FEDERALLY SPONSORED RESEARCH OR DEVELOPMENT

NOT APPLICABLE

REFERENCE A "MICROFICHE APPENDIX"

NOT APPLICABLE

FIELD OF THE INVENTION

This invention relates generally to a new and useful improvement in ladies apparel. More particularly, this invention relates to a ladies bodice support that can be worn with special occasion dresses, including wedding dresses.

BACKGROUND OF THE INVENTION

Throughout history, women have worn special occasion dresses including wedding dresses and other formal evening dresses. These dresses are often uniquely stylized. Special occasion dresses are made with one of many unique necklines such as scoop, V-neck, sweetheart neck, halter or strapless, making it virtually impossible for the wearer to wear a standard brassiere. Moreover, special occasion dresses may have low or no back material, again making it impossible for the wearer to wear a standard brassiere. With these styles, a standard women's brassiere cannot be worn with the dress because the shoulder straps and/or the back strap of the brassiere will show. Moreover, these special occasion dresses often have fuller skirts and are made of heavy material making special occasion dresses considerably heavier than most ladies apparel.

Because of the unique styles and heavier materials of special occasion dresses, clothing designers have attempted to deal with the problem of achieving figure control in the midriff and abdomen areas, as well as bust support with bodices that have a built-in brassiere in one form or another. The constructions of the earlier bodices were different from and inferior to that of the present invention.

SUMMARY OF THE INVENTION

The present invention discloses a composite garment that includes an attached liner including a bodice support which effectively supports and enhances the bust while supporting, smoothing and elongating the bodice of the dress. The present invention is suitable for most figures and can be tailored or customized to compliment most dress styles and body types. The present invention enhances the bust by lifting and supporting. The present invention discloses a bodice support that gently cinches the midriff and abdomen areas of a women's body allowing these areas to appear smoother and smaller. The liner including the bodice support takes up space inside the special occasion dress and therefore, will not necessarily make a smaller dress size fit. The bodice support is only attached to the top edge of the special occasion dress. The present invention allows for comfort and freedom of movement while retaining its placement on the body and within the dress. The present invention allows the outer garment to hang free from the bodice ensuring that no stress points or stretching of the fabric or seams is created and that no stays are visible from the outside of the dress.

In its most simple embodiment, the present invention discloses a composite garment made of a dress and a liner. The dress of the composite garment has a top edge and a fastenable opening. The liner of the composite garment is made of a bodice support and a slip. The bodice support has a top edge and bottom edge. The bodice support has a fastenable opening coexistent with the fastenable opening of the dress. The bodice support is made of a plurality of stays which are used to support the midriff, abdomen and bust of the wearer. The stays extend from substantially the top edge of the bodice support to the bottom edge of the bodice support. The stays are placed in close proximity to each other. In one embodiment, the stays are plastic. In another embodiment, the stays are metal. The stays are placed within zero centimeters of each other, or side by side, to three and one-half centimeters of each other. The stays may be placed within three and one-half centimeters to approximately seven and one-half centimeters from each other. There are at least eight stays. In one embodiment, at least two stays are placed side by side in the center front of said bodice support. The slip of the liner is attached to the bottom edge of the bodice support. The top edge of the dress is attached to the top edge of the bodice support.

The present invention discloses a bodice support that has bust cups. Each bust cup has a perimeter that is a rigid arcuate brace. At least one horizontal stay traverses the bust cup. At least one vertical stay traverses each bust cup and runs continuously into the midriff and abdomen areas of the bodice support. At least one horizontal stay connects the inner perimeters of the bust cups.

In a second embodiment of the present invention, the bodice support is not attached to the dress. The bodice support has a top edge and a bottom edge. The bodice support is made of a center front panel, two side front panels, two side back panels, two back panels, a plurality of stays, and a fastenable opening. The front center panel of the bodice support extends vertically from the top edge of the bodice support to the bottom edge of the bodice support. The two side front panels are attached to opposite sides of the center front panel and extend vertically from the top edge of the bodice support to the bottom edge of the bodice support. The two side back panels are attached to the side front panels and extend vertically from the top edge of the bodice support to the bottom edge of the bodice support. The two back panels are attached to the side back panels and extend vertically from the top edge of the bodice support to the bottom edge of the bodice support. A plurality of stays extend substantially the entire length of the center front panel, side front panels, side back panels, and back panels. The stays are placed within close proximity to one another. The stays are placed within zero centimeters of each other, or side by side, to three and one-half centimeters of each other. The stays may be placed within three and one-half centimeters to approximately seven and one-half centimeters from each other. There are at least eight stays. In one embodiment, at least two stays are placed side by side in the center front of the bodice support. The stays are plastic or metal. The fastenable opening is between the back panels. If desired, the top edge of the bodice support can be attached to the top edge of a dress.

In one embodiment, the center front panel has bust cups. Each bust cup has a perimeter that is a rigid arcuate brace. At least one horizontal stay traverses each bust cup. At least one vertical stay traverses each bust cup and runs continuously into the midriff and abdomen areas of the bodice support. At least one horizontal stay connects the inner perimeters of the bust cups.

The present invention also discloses a method to manufacture a composite garment. This method involves the steps of (1) obtaining a dress having a top edge, a fastenable opening, and a seam allowance; (2) obtaining a liner comprising a bodice support and a slip, the bodice support has a top edge and a bottom edge, a fastenable opening coexistent with the fastenable opening of the dress, a plurality of stays which extend from substantially the top edge of the bodice support to the bottom edge of the bodice support and which are placed in close proximity to each other, and a seam allowance, the slip is attached to the bottom edge of the bodice support; (3) altering the seam allowance in the dress to accommodate the wearer of the dress; (4) altering the seam allowance in the bodice support of the liner to accommodate the wearer of the liner; and (5) attaching the top edge of the dress to the top edge of the bodice support.

In one embodiment, the seam allowance in the dress is three to five inches and the seam allowance in the bodice support is three to four inches.

DETAILED DESCRIPTION OF THE INVENTION

In the following detailed description of the preferred embodiments, reference is made to the accompanying drawings which form a part hereof, and in which are shown by way of illustrating specific embodiments in which the invention may be practiced. It is understood that other embodiments may be utilized and structural changes may be made without departing from the scope of the present invention.

As used by Applicants in this application hereto:

(1) "attached to" refers to the joining of two pieces of material by sewing approximately one-fourth inch to five-eighths inch from the edge;

(2) "bodice" refers to the upper region of a woman's dress;

(3) "bodice support" refers to a woman's close-fitting supporting undergarment that is fastenable and which extends from above or beneath the bust to the waist or below the waist;

(4) "bottom edge" refers to the bottom surface line of the bodice support;

(5) "close proximity" refers to being near in space and relationship;

(6) "dart" refers to a stitched tapering fold in a garment;

(7) "dress" refers to a one-piece garment, which contains lining, for a woman or girl that covers the body and extends down over the legs usually consisting of a bodice and skirt;

(8) "interfacing" refers to fabric sewn between the facing and the outside of a garment for stiffening and shaping retention;

(9) "interlining" refers to a lining sewn between the ordinary lining and the outside fabric;

(10) "liner" refers to the combination of a bodice support and slip, which is attachable to a dress;

(11) "lining" refers to a material that is used to line the inner surface of a dress;

(12) "obtaining a dress" refers to manufacturing the dress oneself or coming into possession of a dress manufactured by another;

(13) "obtaining a liner" refers to manufacturing the liner oneself or coming into possession of the liner manufactured by another;

(14) "slip" refers to an underskirt which is usually a little shorter than outer clothing and often made with a ruffled, pleated, or lace edge;

(15) "stay" refers to a thin firm strip interlaced throughout the materials of a bodice support to provide support to the midriff, abdomen and bust;

(16) "top edge" refers to the top surface line of the dress or the bodice support;

(17) "top stitch" refers to making a line of stitching on the outside of the composite garment close to the seam;

(18) "underwire" refers to circular or semicircular wire support stitched around or under the bust cups;

(19) "zero centimeters" refers to stays placed side by side each other.

Figure 1:
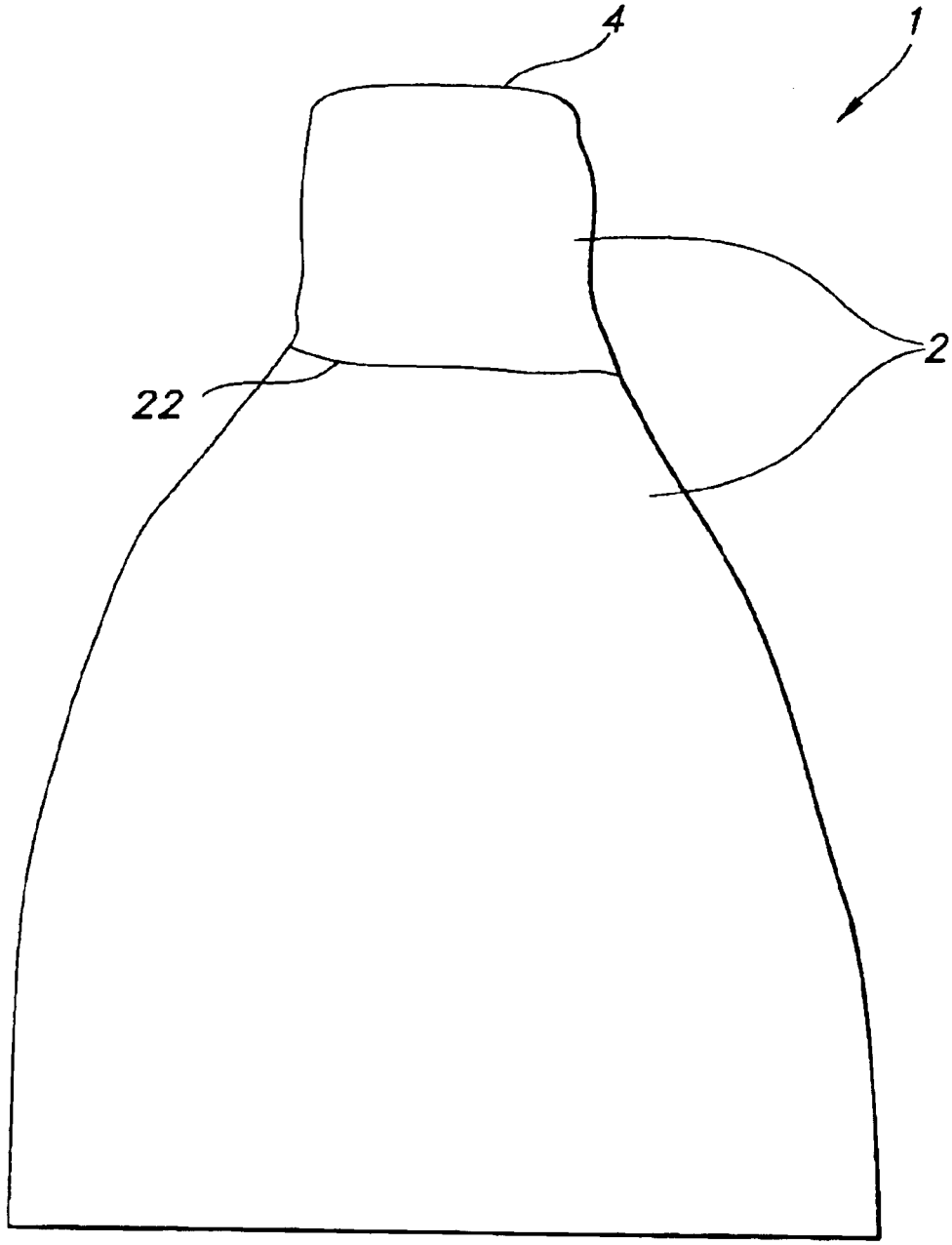
FIG. 1 is a front perspective view of the composite garment.
Figure 2:
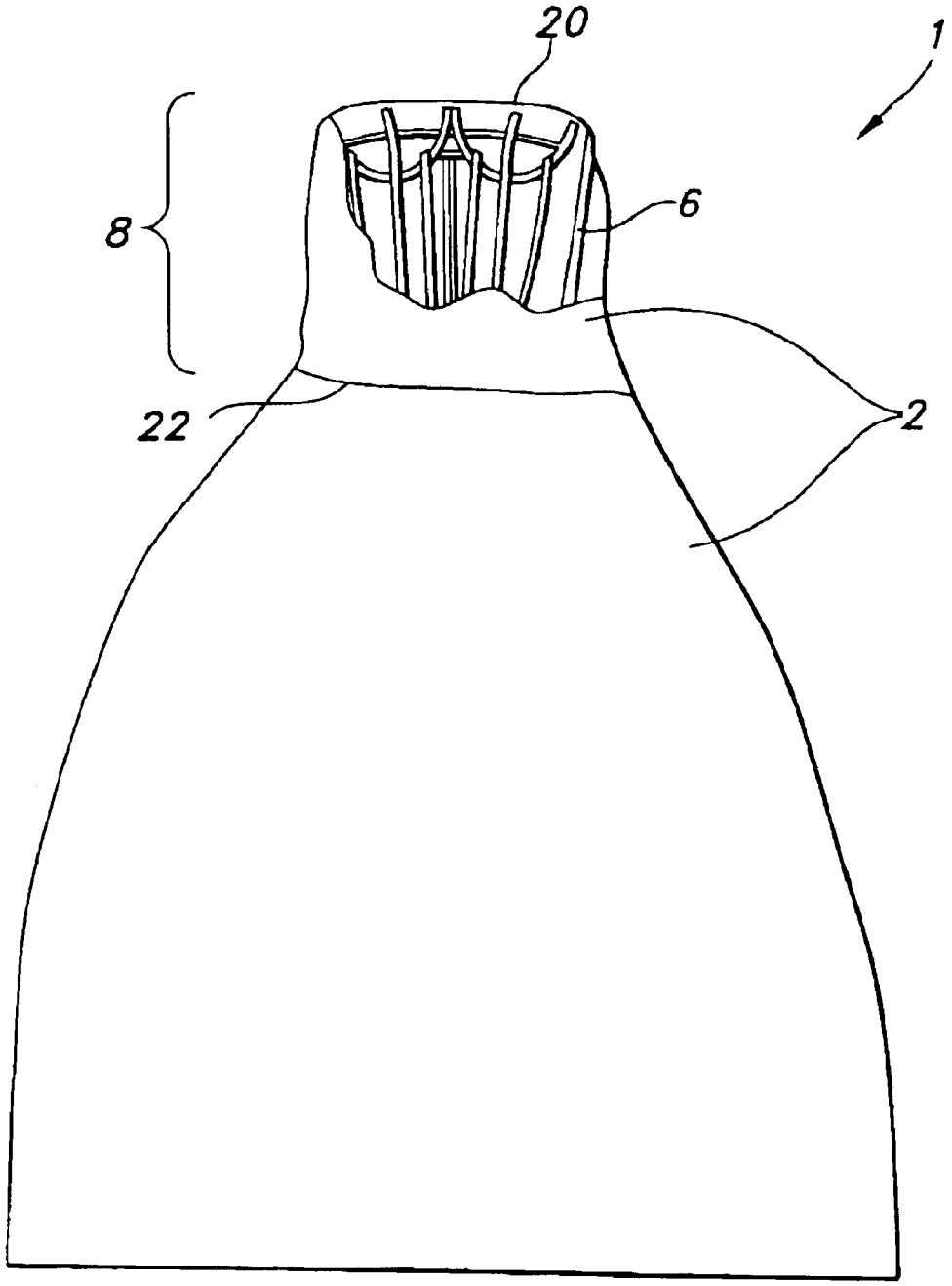
FIG. 2 is a front perspective view of the composite garment with certain parts away to show details of the bodice support of the liner.

Referring now to FIGS. 1–2, the composite garment 1 is made of a dress 2 and a liner 6. In the preferred embodiment, the dress 2 has a top edge 4 and a fastenable opening 10 (shown in FIGS. 3–4). The dress 2 is preferably made of satin, silk, or polyester blends, but any material or combination of materials may be used as desired by one skilled in the art. Dress 2 contains lining. Dress 2 is of any size as desired by one skilled in the art. Dress 2, as shown in FIGS. 1 and 2, has a natural waistline 22, but any other waistline may be used as desired by one skilled in the art. Also, as shown in FIGS. 1 and 2, dress 2 has a strapless neckline, but any other neckline may be used as desired by one skilled in the art. For example, in one embodiment, the top edge 4 of dress 2 forms a strapless neckline (see FIGS. 1–2). In another embodiment, top edge 4 of dress 2 forms a halter neckline (see FIG. 4). In a preferred embodiment, fastenable opening 10 (shown in FIG. 3) is preferably a zipper, but any other fastenable opening may be used as desired by one skilled in the art.

Referring again to FIGS. 1–4, the liner 6 is made of a bodice support 8 and a slip 12 (best seen in FIGS. 3 and 4). The bodice support 8 has a top edge 20 and a bottom edge 21. The top edge 20 of bodice support 8 is attached to the top edge 4 of the dress 2. The bodice support 8 is preferably made of two layers of polyester lining and one layer of iron-on interfacing, but any other material or combination of materials may be used as desired by one skilled in the art. In a preferred embodiment, two darts are placed in the bodice support 8, but more or less darts may be used as desired by one skilled in the art. The length of bodice support 8 is dependent on the style and size of dress 2 chosen by the wearer. The length of bodice support 8 is the distance from the top edge 20 to the bottom edge 21. In one embodiment, the bottom edge 21 of bodice support 8 is at the natural waistline 22. In another embodiment, the bottom edge 21 of bodice support 8 is extended to follow a dropped waistline (not shown) of dress 2. The dropped waistline is preferably extended one to four inches below the natural waistline 22, but any other length extension may be used as desired by one skilled in the art. The top edge 20 of bodice support 8 is made to align with the neckline and back of dress 2. The width of bodice support 8 is dependent on the size of dress 2 desired by the wearer. Bodice support 8 is dependent on and consistent with the size and style of the dress 2, including the waistline, neckline, and back of dress 2.

Figure 3:
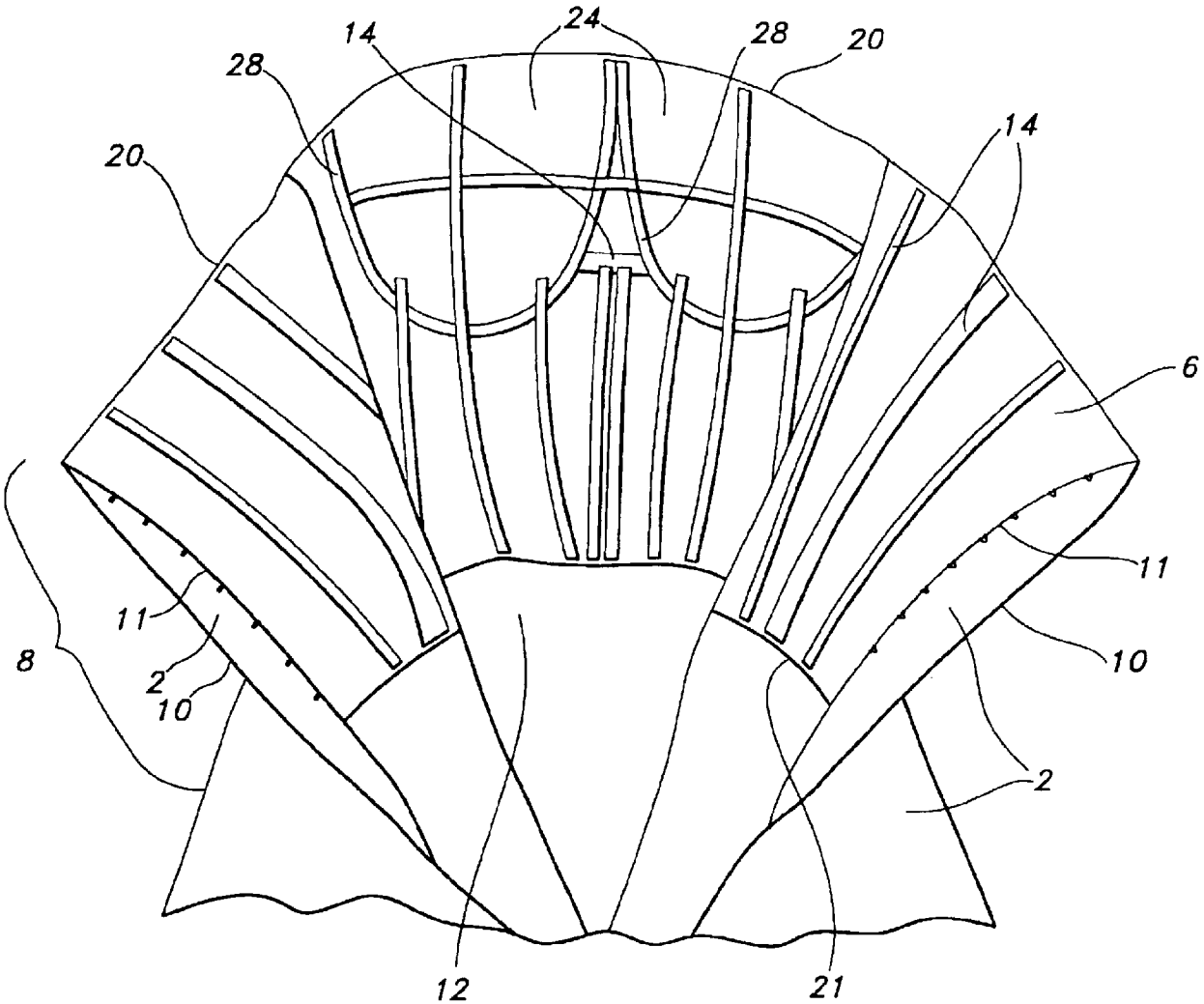
FIG. 3 is a rear elevational view of the composite garment showing the liner, ng the strapless bodice support and attached slip.
Figure 4:
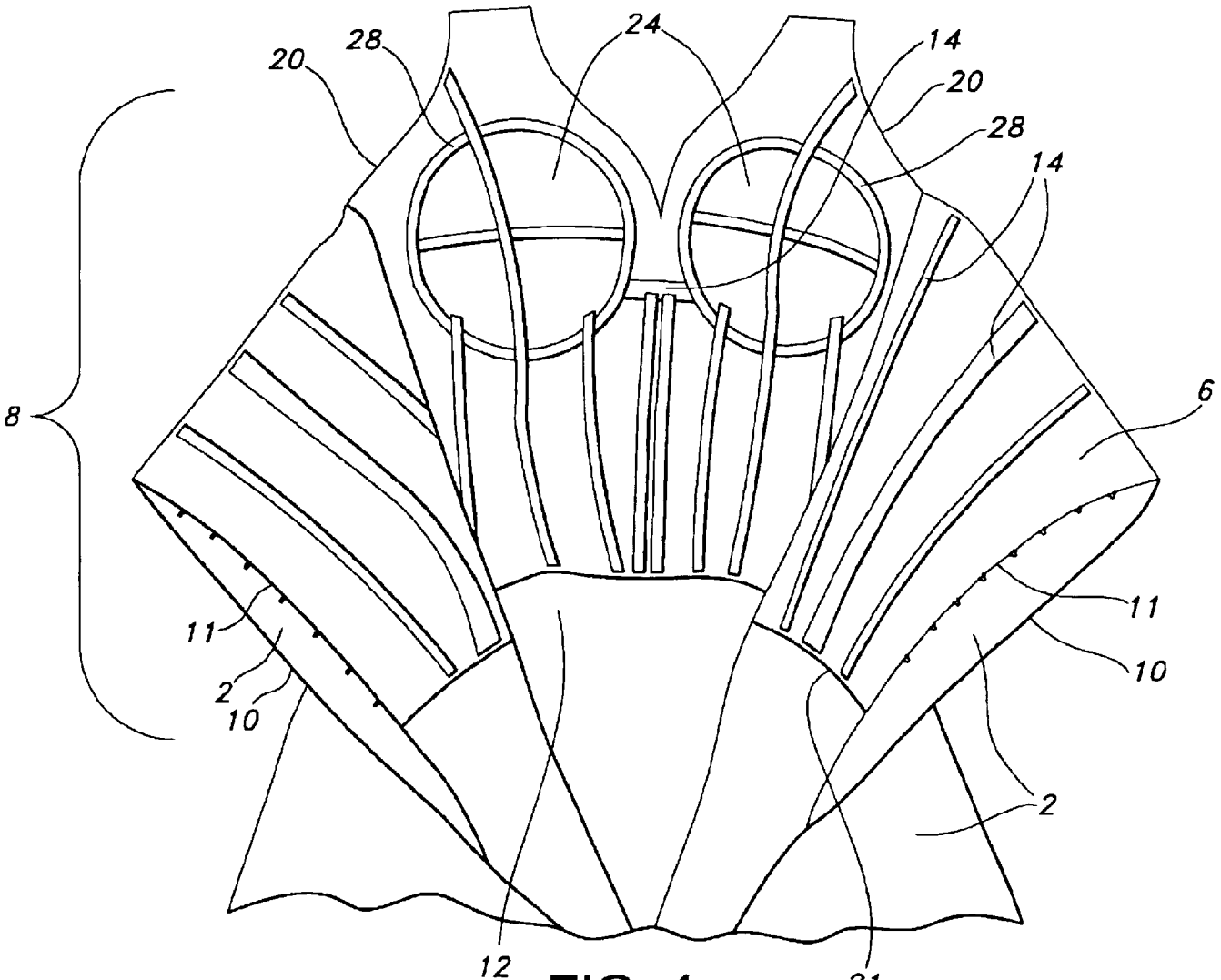
FIG. 4 is a rear elevational view of the composite garment showing the liner, ng the halter bodice support and attached slip.

Referring now to FIGS. 3–4, the bodice support 8 has a plurality of stays 14 extending from substantially the top edge 20 of bodice support 8 to the bottom edge 21 of bodice support 8. In one embodiment, stays 14 are plastic. In a second embodiment, stays 14 are metal. Metal stays 14 are preferably used with larger size dresses to strengthen the support to the abdomen, midriff, and bust provided by the bodice support 8 to the wearer. Stays 14 may be made of any other material as desired by one skilled in the art. Stays 14 may be curved. Stays 14 are preferably one half centimeter to one centimeter in width, but stays 14 of other widths may be used as desired by one skilled in the art. The length of stays 14, the number of stays 14 used in bodice support 8, and the placement of stays 14 within bodice support 8 are dependent on the style and size of bodice support 8, which is dependent on the size and style of dress 2. The length of stays 14 is dependent on and consistent with the length of bodice support 8. In one embodiment, the back of dress 2 and bodice support 8 is low and therefore, stays 14 located in the back of bodice 8 are shorter in length. Stays 14 can be sewn down the middle to keep the stays 14 narrow.

Stays 14 are placed within close proximity to each other. The placement of stays 14 is dependent on the style and size of the dress 2. The larger the size of dress 2, the greater the number of stays 14 used in bodice support 8. The less material used in the style of the bodice support 8 (such as if the bodice support 8 were backless), the greater the number of stays 14 used to provide support to the wearer. Stays 14 are placed within zero centimeters from each other, or side by side, to three and one-half centimeters from each other, but stays 14 may be placed up to approximately seven and one-half centimeters apart as desired by one skilled in the art. In the preferred embodiment, two stays 14 are placed vertically side by side in the center front of the bodice support 8 to support bust cups 24. The number of stays 14 and the placement of stays 14 in bodice support 8 vary as the size and style of dress 2 vary to provide support to the wearer. In one embodiment, dress 2 is backless and therefore, bodice support 8 has more stays 14 in the front of bodice support 8 and stays 14 are spatially placed as needed to provide support to the wearer. Stays 14 are placed within bodice support 8. Stays 14 are spatially placed throughout bodice support 8 to support and enhance the midriff, abdomen, and bust of the wearer. Bodice support 8 has at least eight stays 14, but more stays 14 may be used as desired by one skilled in the art. For example, bodice support 8 is made to accommodate a ladies dress size fourteen and has eighteen stays 14 within bodice support 8.

Referring again to FIGS. 3–4, the bodice support 8 has a fastenable opening 11 coexistent with the fastenable opening 10 of dress 2. In the preferred embodiment, fastenable opening 11 of bodice support 8 is made of hooks and eyes, but other materials may be used as desired by one skilled in the art.

Referring now to FIGS. 3–4 and 5–6, bodice support 8 has bust cups 24 configured to receive and support the breasts of the wearer. Bust cups 24 are made of polyester lining and interfacing, but any other material or combination of materials may be used as desired by one skilled in the art. Bust cups 24 may contain different amounts and types of padding material as desired by one skilled in the art to provide more or less support and enhancement to the breasts. Each bust cup 24 has a perimeter 28 (see FIGS. 5 and 6). Perimeter 28 is a rigid arcuate brace. In one embodiment, one horizontal stay 14 traverses bust cups 24 and runs continuously across bust cups 24. In another embodiment, one horizontal stay 14 traverses the apex of each bust cup 24 and does not run continuously across bust cups 24. One curved vertical stay 14 traverses the apex of each bust cup 24 and runs continuously into the midriff and abdomen areas of the bodice support 8. In a preferred embodiment, vertical stay 14 which traverses the apex of each bust cup 24 is sewn down the middle to make stay 14 narrow. One horizontal stay 14 connects the inner perimeters 28 of bust cups 24. Perimeter 28 of bust cups 24 is preferably made of metal underwire, but other materials such as plastic may be used as desired by one skilled in the art. In one embodiment, perimeter 28 encircles each entire bust cup 24 (best seen in FIGS. 4 and 6). In another embodiment, perimeter 28 encircles part of each bust cup 24 (best seen in FIGS. 3 and 5). The top edge 20 of bodice support 8 determines the extent to which perimeter 28 encircles each bust cup 24.

Referring again to FIGS. 3–4, slip 12 of liner 6 is attached to the bottom edge 21 of bodice support 8. Slip 12 is not attached to dress 2. Slip 12 is preferably made of polyester lining, but other materials, such as silk, or combination of materials may be used as desired by one skilled in the art.

Top edge 20 of bodice support 8 is attached to the top edge 4 of dress 2. Bodice support 8 is approximately one-half inch smaller than the bodice of dress 2. Top edge 4 of dress 2 and top edge 20 of bodice support 8 have no seam allowance for alteration. In a preferred embodiment, a top stitch is sewn to top edges 4 and 20 to ensure the placement of dress 2. Dress 2 has a seam allowance that may be altered to accommodate the wearer of dress 2. The seam allowance is located on each side and center back of the bodice of dress 2. The seam allowance in dress 2 is approximately three to five inches. Liner 6 has a seam allowance that may be altered to accommodate the wearer. The seam allowance in liner 6 is approximately three to four inches and is located on the side and center back of bodice support 8. In a preferred embodiment, the seam allowance in liner 6 corresponds to any alteration made to the seam allowance in dress 2. At least one stay 14 is placed on the reverse side of each side seam allowance in bodice support 8 (not shown).

Figure 5:
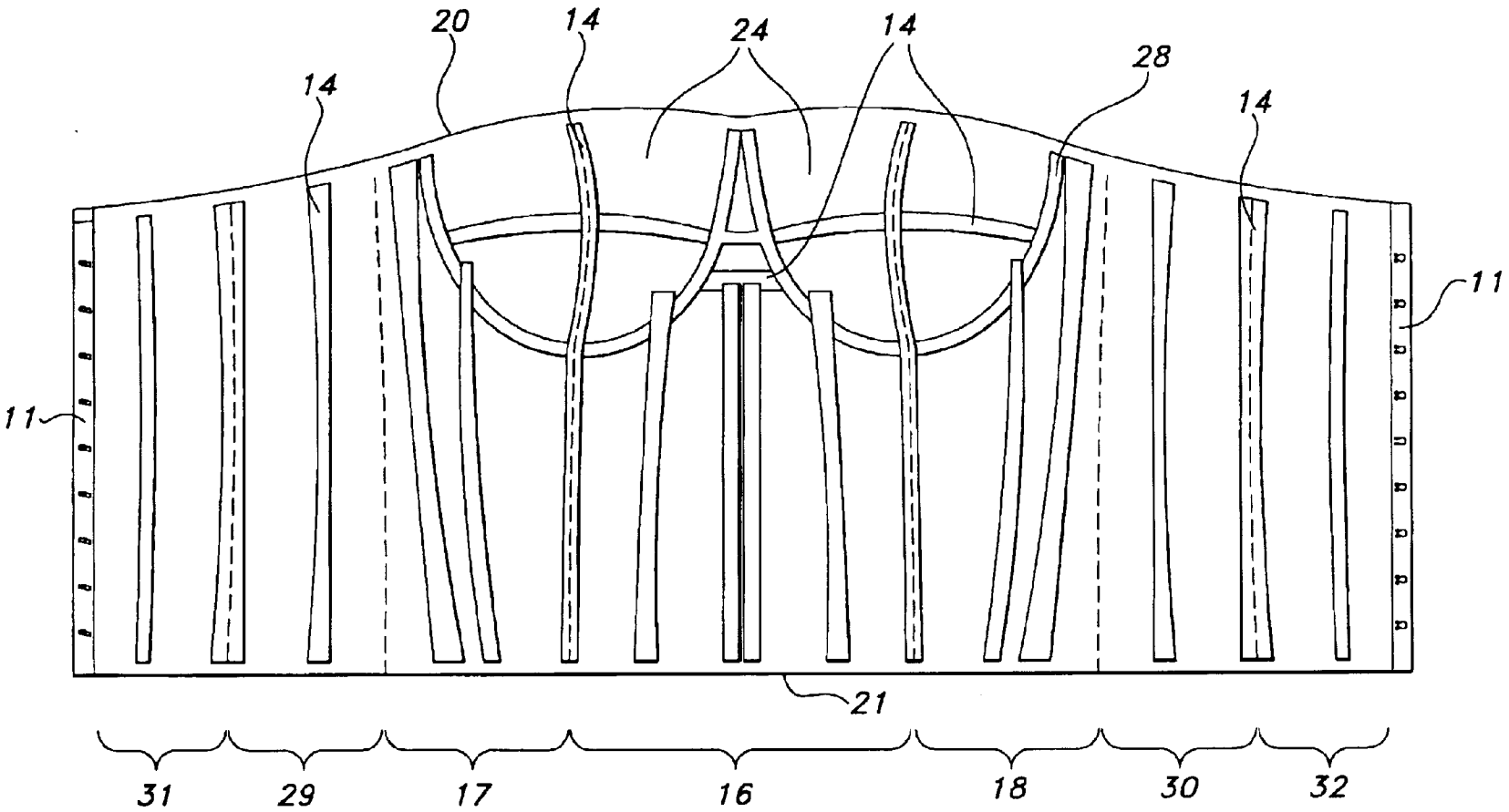
FIG. 5 is a perspective view of a strapless bodice support.
Figure 6:
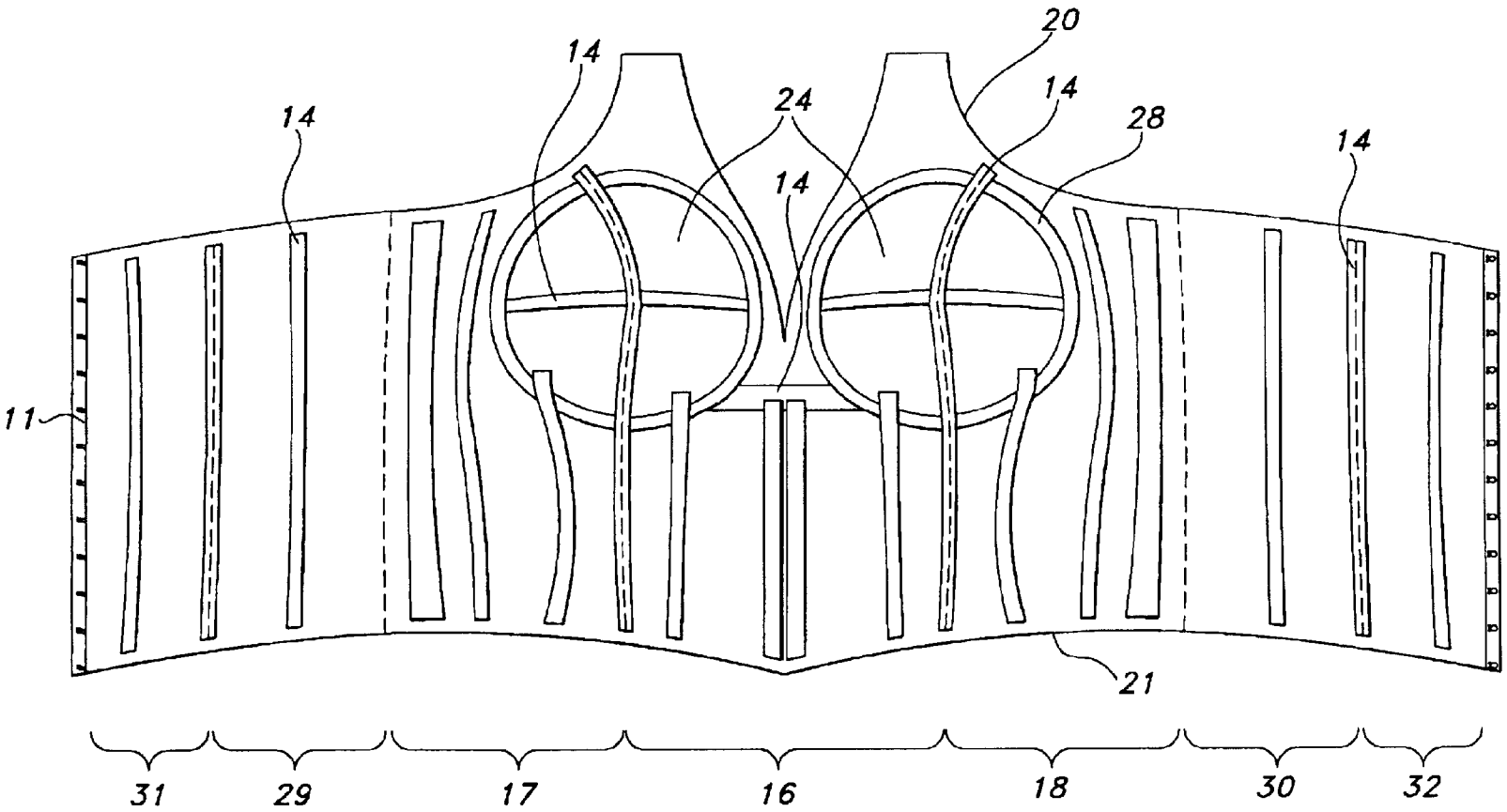
FIG. 6 is a perspective view of a halter bodice support.

Referring now to FIGS. 5–6, the present invention also discloses a bodice support 8 of a composite garment 1. The bodice support 8 is not attached to dress 2. Bodice support 8 is made of a center front panel 16, side front panels 17 and 18, side back panels 29 and 30, back panels 31 and 32, a plurality of stays 14 and a fastenable opening 11. Center front panel 16 extends vertically from the top edge 20 of bodice support 8 to the bottom edge 21 of bodice support 8. Side front panels 17 and 18 are attached to opposite sides of center front panel 16. Side front panels 17 and 18 extend vertically from top edge 20 of bodice support 8 to bottom edge 21 of bodice support 8. Side back panels 29 and 30 are attached to side front panels 17 and 18. Side back panels 29 and 30 extend vertically from top edge 20 of bodice support 8 to bottom edge 21 of bodice support 8. Back panels 31 and 32 are attached to side back panels 29 and 30. Back panels 31 and 32 extend vertically from top edge 20 of bodice support 8 to bottom edge 21 of bodice support 8. Panels 16, 17, 18, 29, 30, 31 and 32 are made of two layers of polyester lining and one layer of iron-on interfacing, but any other materials or combination of materials may be used as desired by one skilled in the art. In a preferred embodiment, two darts are placed in the bodice support 8, but more or less darts may be used as desired by one skilled in the art.

Referring to FIGS. 5 and 6, the lengths of center front panel 16, side front panels 17 and 18, side back panels 29 and 30, and back panels 31 and 32 are dependent on the style and size of bodice support 8 desired by the wearer. The lengths of panels 16, 17, 18, 29, 30, 31 and 32 are the distance from the top edge 20 of bodice support 8 to the bottom edge 21 of bodice support 8. In one embodiment, the bottom edge 21 of panels 16, 17, 18, 29, 30, 31 and 32 is at the natural waistline 22 (seen in FIG. 2). In another embodiment, the bottom edge 21 of panels 16, 17, 18, 29, 30, 31 and 32 is extended to follow a dropped waistline (not shown) of bodice support 8. The dropped waistline is preferably extended one to four inches below the natural waistline 22, but any other length extension may be used as desired by one skilled in the art. The width of panels 16, 17, 18, 29, 30, 31 and 32, when said panels are attached, is dependent on the size of bodice support 8 desired by the wearer. Importantly, panels 16, 17, 18, 29, 30, 31 and 32 may be made to align with the waistline, neckline, and back of an outer dress or other ladies garment. A fastenable opening 11 is coexistent with the fastenable opening 10 of dress 2 and is between back panels 31 and 32. In the preferred embodiment, fastenable opening 11 is made of hook and eyes, but other materials may be used as desired by one skilled in the art.

Referring now to FIGS. 5–6, the center front panel 16, side front panels 17 and 18, side back panels 29 and 30, and back panels 31 and 32 have a plurality of stays 14 extending substantially the entire length of said panels 16, 17, 18, 29, 30, 31 and 32. In one embodiment, stays 14 are plastic. In a second embodiment, stays 14 are metal. Metal stays are preferably used with larger size dresses to strengthen the support to the abdomen, midriff, and bust provided by said panels 16, 17, 18, 29, 30, 31 and 32 to the wearer. Stays 14 may be made of any other material as desired by one skilled in the art. Stays 14 may be curved. Stays 14 are preferably one half centimeter to one centimeter in width, but stays of other widths may be used as desired by one skilled in the art. The length of stays 14, the number of stays 14 used in said panels 16, 17, 18, 29, 30, 31 and 32, and the placement of stays 14 within bodice support 8 are dependent on the style and size of bodice support 8, which is dependent on the size and style of dress 2. The length of stays 14 is dependent on the length of bodice support 8. The stays 14 can be sewn down the middle to keep the stays 14 narrow.

Stays 14 are placed within close proximity to each other. The placement of stays 14 is dependent on the style and size of dress 2. The larger the size of dress 2, the greater the number of stays 14 used in bodice support 8. The less material used in the style of bodice support 8 (such as if the bodice support 8 were backless), the greater the number of stays 14 used to provide support to the wearer. Stays 14 are placed within zero centimeters from each other, or side by side, to three and one-half centimeters from each other, but stays 14 may be placed up to approximately seven and one-half centimeters apart as desired by one skilled in the art. In the preferred embodiment, two stays 14 are placed side by side in the center front of bodice support 8 to support bust cups 24. The number of stays 14 and the placement of stays 14 in said panels 16, 17, 18, 29, 30, 31 and 32 vary as the size and style of bodice support 8 vary to provide more support to the wearer. For example, in one embodiment, dress 2 is backless and therefore, bodice support 8 has more stays 14 in the front of bodice support 8 and stays 14 are spatially placed as needed to provide support to the wearer. Stays 14 are placed within said panels 16, 17, 18, 29, 30, 31 and 32. Stays 14 are spatially placed throughout the panels 16, 17, 18, 29, 30, 31 and 32 to support and enhance the midriff, abdomen, and bust of the wearer. Bodice support 8 has at least eight stays 14, but more stays 14 may be used as desired by one skilled in the art. For example, panels 16, 17, 18, 29, 30, 31 and 32 are made to accommodate a ladies dress size fourteen and have eighteen stays 14 within panels 16, 17, 18, 29, 30, 31 and 32.

Referring again to FIGS. 5–6, center front panel 16 has bust cups 24. Bust cups 24 are configured to receive and support the breasts of the wearer. Bust cups 24 are made of polyester lining and interfacing, but any other material or combination of materials may be used as desired by one skilled in the art. Bust cups 24 may contain different amounts and types of padding material as desired by one skilled in the art to provide more or less support and enhancement to the bust. Bust cups 24 have a perimeter 28, which is a rigid arcuate brace made of metal underwire, but any other material such as plastic may be used as desired by one skilled in the art. Perimeter 28 encircles bust cups 24. In one embodiment, perimeter 28 encircles the entire bust cups 24 (best seen in FIG. 6). In another embodiment, perimeter 28 encircles part of bust cups 24 (best seen in FIG. 5). The top edge 20 of bodice support 8 determines the extent to which perimeter 28 completely or partially encircles bust cups 24. In a preferred embodiment, one horizontal stay 14 traverses bust cups 24 and runs continuously across bust cups 24. In another embodiment, one horizontal stay traverses the apex of each bust cup 24 and does not run continuously across bust cups 24. One curved vertical stay 14 traverses the apex of each bust cup 24 and runs continuously into the midriff and abdomen areas of bodice support 8. In a preferred embodiment, vertical stay 14, which traverses the apex of bust cups 24, is sewn down the middle to make stay 14 narrow. One horizontal stay connects the inner perimeters 28 of bust cups 24.

Referring now to FIGS. 1–6, the present invention discloses a method to manufacture a composite garment 1 comprising: (a) obtaining a dress 2 which has a top edge 4, a fastenable opening 10, and a seam allowance (not shown); (b) obtaining a liner 6 made of a bodice support 8 and a slip 12, bodice support 8 has a top edge 20 and a bottom edge 21, bodice support 8 has a fastenable opening 11 coexistent with the fastenable opening 10 of dress 2, bodice support 8 has a plurality of stays 14 which extend from the top edge 20 of bodice support 8 to the bottom edge 21 of bodice support 8 and which are placed in close proximity to each other, bodice support 8 has a seam allowance (not shown), slip 12 is attached to the bottom edge 21 of bodice support 8; (c) altering the scam allowance (not shown) in dress 2 to accommodate the wearer of dress 2; (d) altering the seam allowance (not shown) in bodice support 8 of liner 6 to accommodate the wearer of liner 6; (e) attaching the top edge 4 of dress 2 to the top edge 20 of bodice support 8.

Referring now to FIGS. 1–4, the seam allowance (not shown) in dress 2 is approximately three to five inches, but said seam allowance may be more than five inches or less than three inches as desired by one skilled in the art. The seam allowance of dress 2 is located on the sides of the bodice of dress 2 and on the center back beside the fastenable opening 10 of dress 2.

Referring now to FIGS. 5–6, the seam allowance (not shown) in bodice support 8 is approximately three to four inches, but said seam allowance may be more than four inches or less than three inches as desired by one skilled in the art. The seam allowance of bodice support 8 is located where the side front panel 17 attaches to side back panel 29, where side front panel 18 attaches to side back panel 30, and where back panels 31 and 32 attach to fastenable opening 11. At least one stay 14 is placed on the reverse side of each side seam allowance in bodice support 8 (not shown).

I claim:

1. A composite garment made of a dress and a liner comprising:

(a) a dress having a top edge and a fastenable opening; and (b) a liner comprising a bodice support and a slip, said bodice support having a top edge and bottom edge, said bodice support having a fastenable opening coexistent with said fastenable opening of said dress, said bodice support having a plurality of stays extending from substantially the top edge of the bodice support to the bottom edge of said bodice support, wherein said plurality of stays are placed within a close proximity to each other, said slip attached to the bottom edge of said bodice support, wherein the top edge of said bodice support is attached to the top edge of said dress.

2. The composite garment of claim 1 wherein said plurality of stays are placed within zero centimeters to three and one-half centimeters apart from each other.

3. The composite garment of claim 1 wherein said plurality of stays are placed within three and one-half centimeters to seven and one-half centimeters apart from each other.

4. The composite garment of claim 1 wherein there are at least eight stays.

5. The composite garment of claim 1 wherein said plurality of stays are plastic.

6. The composite garment of claim 1 wherein said plurality of stays are metal.

7. The composite garment of claim 1 wherein said bodice support has bust cups, each bust cup having a perimeter, wherein said perimeter is a rigid arcuate brace.

8. The composite garment of claim 7 wherein at least one horizontal stay traverses each bust cup.

9. The composite garment of claim 7 wherein at least one vertical stay traverses each bust cup.

10. The composite garment of claim 7 wherein at least one stay connects the inner perimeters of said bust cups.

11. A bodice support of a composite garment having a top edge and a bottom edge comprising:

(a) a center front panel extending vertically from said top edge to said bottom edge;

(b) side front panels attached to opposite sides of said center front panel, each said side front panel extending vertically from said top edge to said bottom edge;

(c) side back panels attached to opposite sides of said side front panels, each said side back panel extending vertically from said top edge to said bottom edge;

(d) back panels attached to opposite sides of said side back panels, each said back panel extending vertically from said top edge to said bottom edge;

(e) a plurality of stays extending substantially the entire length of said center front panel, side front panels, side back panels, and back panels, wherein said plurality of stays are placed within close proximity to each other; and (f) a fastenable opening between said back panels.

12. The bodice support of claim 11 wherein said plurality of stays are placed within zero centimeters to three and one-half centimeters from each other.

13. The bodice support of claim 11 wherein said plurality of stays are placed within three and one-half centimeters to seven and one-half centimeters from each other.

14. The bodice support of claim 11 wherein there are at least eight stays.

15. The bodice support of claim 11 wherein said center front panel has bust cups, each bust cup having a perimeter wherein said perimeter is a rigid arcuate brace.

16. The bodice support of claim 11 wherein said bodice support has a top edge configured to align with a top edge of a dress.

17. The bodice support of claim 11 wherein said plurality of stays are plastic.

18. The bodice support of claim 11 wherein said plurality of stays are metal.

19. A method to manufacture a composite garment comprising:

(a) obtaining a dress having a top edge, a fastenable opening, and a seam allowance;

(b) obtaining a liner comprising a bodice support and a slip, said bodice support having a top edge and bottom edge, said bodice support having a fastenable opening coexistent with the fastenable opening of said dress, said bodice support having a plurality of stays extending from substantially the top edge of the bodice support to the bottom edge of said bodice support, wherein said plurality of stays are placed within close proximity to each other, said bodice support having a seam allowance, said slip attached to the bottom edge of said bodice support;

(c) altering said seam allowance in said dress to accommodate the wearer of said dress;

(d) altering said seam allowance in said bodice support of said liner to accommodate the wearer of said liner; and (e) attaching the top edge of said dress to the top edge of said bodice support.

20. The method of claim 19 wherein said seam allowance in said dress is three to five inches.

21. The method of claim 19 wherein said seam allowance in said bodice support is three to four inches.

* * * * *